US012378700B2

(12) United States Patent
Sato et al.

(10) Patent No.: US 12,378,700 B2
(45) Date of Patent: Aug. 5, 2025

(54) FLAME-RETARDANT FABRIC AND WORK CLOTHING USING THE SAME

(71) Applicant: KANEKA CORPORATION, Osaka (JP)

(72) Inventors: Motohiro Sato, Hyogo (JP); Akira Ozaki, Hyogo (JP); Wataru Mio, Hyogo (JP)

(73) Assignee: KANEKA CORPORATION, Osaka (JP)

( * ) Notice: Subject to any disclaimer, the term of this patent is extended or adjusted under 35 U.S.C. 154(b) by 18 days.

(21) Appl. No.: 18/517,287

(22) Filed: Nov. 22, 2023

(65) Prior Publication Data

US 2024/0102206 A1 Mar. 28, 2024

Related U.S. Application Data

(63) Continuation of application No. PCT/JP2022/021768, filed on May 27, 2022.

(30) Foreign Application Priority Data

Jun. 4, 2021 (JP) ..... 2021-094197

(51) Int. Cl.

| | |
|---|---|
| ***D01F 6/40*** | (2006.01) |
| ***A41D 13/00*** | (2006.01) |
| ***A41D 31/08*** | (2019.01) |
| ***D01F 6/36*** | (2006.01) |
| ***D04B 1/16*** | (2006.01) |
| ***D04B 1/24*** | (2006.01) |
| ***D04B 21/16*** | (2006.01) |
| ***D04B 21/20*** | (2006.01) |

(52) U.S. Cl.

CPC ..... *D01F 6/40* (2013.01); *A41D 13/00* (2013.01); *A41D 31/08* (2019.02); *D01F 6/36* (2013.01); *D04B 1/16* (2013.01); *D04B 1/24* (2013.01); *D04B 21/16* (2013.01); *D04B 21/207* (2013.01); *A41D 2400/00* (2013.01); *A41D 2500/10* (2013.01); *A41D 2600/20* (2013.01); *D10B 2201/01* (2013.01); *D10B 2201/22* (2013.01); *D10B 2321/101* (2013.01); *D10B 2401/04* (2013.01); *D10B 2501/04* (2013.01)

(58) Field of Classification Search

None

See application file for complete search history.

(56) References Cited

U.S. PATENT DOCUMENTS

| | | | |
|---|---|---|---|
| 5,976,693 | A | 11/1999 | Miyoshi et al. |
| 2006/0090272 | A1 | 5/2006 | Mio et al. |
| 2011/0177740 | A1 | 7/2011 | Waxman |
| 2013/0212790 | A1 | 8/2013 | Waxman et al. |
| 2022/0167700 | A1 | 6/2022 | Ozaki et al. |

FOREIGN PATENT DOCUMENTS

| | | | |
|---|---|---|---|
| CN | 111850726 | A | 10/2020 |
| EP | 4029977 | A1 | 7/2022 |
| JP | H11-021769 | A | 1/1999 |
| JP | 2009-133036 | A | 6/2009 |
| JP | 2013-104058 | A | 5/2013 |
| WO | 2006/043663 | A1 | 4/2006 |
| WO | 2010/010369 | A1 | 1/2010 |
| WO | 2021/049200 | A1 | 3/2021 |

OTHER PUBLICATIONS

International Search Report issued in corresponding International Application No. PCT/JP2022/021768 mailed Jul. 26, 2022 (7 pages).
Written Opinion issued in corresponding International Application No. PCT/JP2022/021768 mailed Jul. 26, 2022 (6 pages).

*Primary Examiner* — Arti Singh-Pandey
(74) *Attorney, Agent, or Firm* — Osha Bergman Watanabe & Burton LLP

(57) ABSTRACT

The present disclosure relates to a flame-retardant fabric that includes a modacrylic fiber and a cellulose fiber. The cellulose fiber is one or more selected from a regenerated cellulose fiber and a natural cellulose fiber. The flame-retardant fabric contains the modacrylic fiber in an amount of 65 to 90 wt % and the cellulose fiber in an amount of 10 to 35 wt % with respect to the overall weight of the fabric. The modacrylic fiber contains a magnesium compound inside the fiber. The flame-retardant fabric contains the magnesium compound in an amount of 2.5 to 4.5 wt %. Afterflame time and afterglow time of the flame-retardant fabric measured using a flammability test based on ISO 15025: 2000 are 2 seconds or less and 2 seconds or less, respectively.

17 Claims, No Drawings

FLAME-RETARDANT FABRIC AND WORK CLOTHING USING THE SAME

TECHNICAL FIELD

One or more embodiments of the present invention relates to a flame-retardant fabric and work clothing produced using the flame-retardant fabric.

BACKGROUND

Firefighters and workers in environments exposed to the risk of flames, such as workplaces in the fields of petroleum, petrochemistry, coal mining, electric power, welding, metalwork, and the like, require flame-retardant work clothing. Fabrics with various compositions have been proposed as fabrics for flame-retardant work clothing. For example, Patent Document 1 proposes a flame-retardant fabric that contains a flame-retardant modacrylic fiber in which an antimony compound is used as a flame retardant, in an amount of 40 to 56 wt %, a natural cellulose fiber in an amount of 5 to 25 wt %, and a flame-retardant viscose fiber in an amount of 20 to 40 wt %.

PATENT DOCUMENTS

Patent Document 1: WO 2010/010369

However, in recent years, there has been concern that elution or discharge of an antimony compound serving as a flame retardant affects the environment, and an improvement has been required. Furthermore, an improvement in the texture and washing durability has also been required from the viewpoint of repeatedly using work clothing while ensuring excellent flame retardancy. Also, there has been room for improvement from the viewpoint of cost.

SUMMARY

One or more embodiments of the present invention provide a flame-retardant fabric whose environmental impact is not of concern and has high flame retardancy as well as excellent washing durability and texture, and work clothing produced using the flame-retardant fabric.

One or more embodiments of the present invention relate to a flame-retardant fabric including: a modacrylic fiber; and a cellulose fiber, wherein the cellulose fiber is one or more selected from the group consisting of a regenerated cellulose fiber and a natural cellulose fiber, the flame-retardant fabric contains the modacrylic fiber in an amount of 65 to 90 wt % and the cellulose fiber in an amount of 10 to 35 wt % with respect to the overall weight of the fabric, the modacrylic fiber contains a magnesium compound inside the fiber, the flame-retardant fabric contains the magnesium compound in an amount of 2.5 to 4.5 wt % with respect to the overall weight of the fabric, and afterflame time and afterglow time of the flame-retardant fabric measured using a flammability test based on ISO 15025: 2000 are 2 seconds or less and 2 seconds or less, respectively.

One or more embodiments of the present invention relate to work clothing produced using the flame-retardant fabric.

One or more embodiments of the present invention can provide a flame-retardant fabric whose environmental impact is of less concern and that has favorable flame retardancy, washing durability, and texture, and work clothing produced using the flame-retardant fabric.

DETAILED DESCRIPTION OF THE EMBODIMENTS

The inventors of one or more embodiments of the present invention found that, by using predetermined amounts of a modacrylic fiber and a cellulose fiber in a fabric containing a modacrylic fiber and a cellulose fiber and adding a predetermined amount of a magnesium compound thereto, concern regarding environmental impact is reduced, excellent flame retardancy is exhibited, the afterflame time and the afterglow time are reduced in a flammability test, and, particularly surprisingly, favorable washing durability and texture can also be imparted. In the present disclosure, the "afterflame time" and the "afterglow time" can be measured using a flammability test based on ISO 15025: 2000. In the present disclosure, the "washing durability" means that favorable flame retardancy is maintained even after washing. In the case where a flame retardant is attached to the surface of a fiber or cloth, the flame retardant is likely to be removed during washing, which leads to poor washing durability. However, the flame-retardant fabric according to one or more embodiments of the present invention has favorable washing durability due to use of a modacrylic fiber containing a magnesium compound inside the fiber.

The flame-retardant fabric according to one or more embodiments of the present invention contains a magnesium compound and substantially no antimony compound, thus making it possible to reduce concern regarding the environmental impact and reduce the cost. In this specification, the wording "containing substantially no antimony compound" means that an antimony compound serving as a flame retardant is not added to a fiber or a fabric on purpose.

In this specification, when a numerical range is shown using "to", the numerical range includes the values at both ends (i.e., the upper limit and the lower limit). For example, a numerical range "A to B" is a range that includes A and B, which are the values at the two ends of the range. Also, when a plurality of numerical ranges are described in this specification, numerical ranges obtained by using the upper limits and the lower limits of the different numerical ranges in combination as appropriate are included.

Magnesium Compound

In one or more embodiments of the present invention, the fabric contains a magnesium compound as a flame retardant, and thus a char layer is likely to be formed during combustion, and favorable flame retardancy and washing durability are achieved.

In the flame-retardant fabric according to one or more embodiments of the present invention, the ratio of the magnesium compound to the overall weight of the fabric may be 2.5 to 4.5 wt %, 2.6 to 4.5 wt %, 2.7 to 4.5 wt %, 2.8 to 4.5 wt %, 2.9 to 4.5 wt %, 3.0 to 4.5 wt %, 3.1 to 4.5 wt %, 3.2 to 4.5 wt %, 3.3 to 4.5 wt %, 3.4 to 4.4 wt %, 3.5 to 4.4 wt %, 3.6 to 4.4 wt %, 3.7 to 4.4 wt %, 3.8 to 4.3 wt %, or 3.9 to 4.3 wt %. If the ratio of the magnesium compound is less than 2.5 wt %, sufficient flame retardancy is not achieved, and if the ratio of the magnesium compound is more than 4.5 wt %, high flame retardancy is favorably achieved, but the texture, feel, fiber strength, and cloth strength are impaired.

In one or more embodiments of the present invention, the average particle diameter of the magnesium compound may be 0.3 μm or more, 0.3 to 2.0 μm, or 0.5 to 1.5 μm. When the average particle diameter is 0.3 μm or more, the surface area of the magnesium compound particle does not excessively increase, and electrostatic generation is suppressed during a fiber processing step such as spinning, which facilitates the processing. When the average particle diameter is 2.0 μm or less, blockage of a spinneret is avoided during a spinning process, which makes for preferable production. In this specification, for example, the average particle diameter of the magnesium compound in the form of a powder can be measured through laser diffractometry, and the average particle diameter of the magnesium compound in a dispersion (dispersion liquid) obtained by dispersing the magnesium compound in water or an organic solvent can be measured through laser diffractometry or by using a dynamic light scattering method. The average particle diameter of the magnesium compound inside a fiber can be examined by, for example, measuring the particle diameters of a hundred particles of the magnesium compound inside a fiber using a microscope and determining the arithmetic average diameter.

In one or more embodiments of the present invention, the magnesium compound is contained inside the modacrylic fiber. The modacrylic fiber may contain the magnesium compound in an amount of 2.8 to 6.9 wt %, 3.0 to 6.7 wt %, 3.2 to 6.5 wt %, or 3.5 to 6.0 wt %, with respect to the overall weight of the fiber. If the content of the magnesium compound is less than 2.8 wt %, there is a risk that the flame retardancy will be insufficient. Meanwhile, if the content of the magnesium compound exceeds 6.9 wt %, there is a risk that the insulation resistance value will increase during fiber processing such as spinning, and electrostatic generation is likely to occur, and thus an issue such as winding occurs during a carding process, which impairs the processing.

In one or more embodiments of the present invention, examples of the magnesium compound include magnesium oxide, magnesium peroxide, magnesium hydroxide, magnesium fluoride, magnesium chloride, magnesium bromide, magnesium iodide, magnesium hydride, magnesium diboride, magnesium nitride, magnesium sulfide, magnesium carbonate, calcium magnesium carbonate, magnesium nitrate, magnesium sulfate, magnesium sulfite, magnesium perchlorate, trimagnesium phosphate, magnesium permanganate, and magnesium phosphate. Of these compounds, magnesium oxide and magnesium hydroxide may be used from the viewpoint of ease of handling. Furthermore, magnesium hydroxide may be used from the viewpoint of Mohs hardness.

In one or more embodiments of the present invention, the Mohs hardness of the magnesium compound may be less than 5, or 4 or less. The "Mohs hardness" herein is the indicator of mineral hardness. For example, a Mohs hardness of 5 is a degree of hardness at which making a scratch with a knife is not easy but possible, and a Mohs hardness of 6 is a degree of hardness at which making a scratch with a knife is difficult and the knife is damaged. Magnesium hydroxide and magnesium oxide can be used to ensure the same flame retardancy as that exhibited by an antimony compound, which is a conventional flame retardant. Furthermore, in the case of spinning a fiber containing a magnesium compound, a fiber containing magnesium hydroxide can be spun more stably than a fiber containing magnesium oxide. The reason for this is a matter of speculation, but is assumed to be as follows. That is, since magnesium hydroxide, whose Mohs hardness is about 3, is softer than magnesium oxide, whose Mohs hardness is about 7, abrasion of a cutter blade is suppressed when a modacrylic fiber containing a magnesium hydroxide compound or a knitted fabric containing this modacrylic fiber is cut, and thus abrasion of a spinning machine is suppressed. Note that the minimum value of Mohs hardness is 1.

In one or more embodiments of the present invention, there is no particular limitation on the magnesium hydroxide compound, but examples thereof include powder obtained by pulverizing natural brucite, powder obtained by neutralizing an aqueous solution of a magnesium salt with an alkali, powder obtained by treating magnesium hydroxide particles with a phosphate, a borate, or the like, and a magnesium hydroxide compound obtained using a method of hydrating magnesium oxide to gradually generate magnesium hydroxide. Furthermore, the magnesium hydroxide compound may have a coating layer that is adsorbed by an adsorbable substance around the particles of the magnesium hydroxide compound, or that is formed through surface treatment with surface treatment agent. In particular, magnesium hydroxide having a coating layer formed through surface treatment with a silane coupling agent is preferable from the viewpoint of suppressing static electricity. The reason why suppression of static electricity is improved through surface treatment with a silane coupling agent is a matter of speculation, but is considered to be as follows. It is conceivable that performing silane coupling treatment on the surface of a magnesium hydroxide particle improves the dispersibility of a modacrylic fiber and the magnesium hydroxide subjected to the silane coupling treatment, which results in suppression of static electricity. Furthermore, when a process of attaching oil to the fiber surface is performed for the purpose of improving the processability, an effect of the oil sufficiently reaches the surface of the magnesium hydroxide particle as well, and thus the processability is significantly improved. There is no particular limitation on the type of silane coupling agent as long as the compatibility with an acrylonitrile copolymer, which will be described later, is improved, and both a cross-linked silane coupling agent and a non-cross-linked silane coupling agent can be used.

Modacrylic Fiber

In one or more embodiments of the present invention, the modacrylic fiber may be made of an acrylonitrile copolymer formed through copolymerization of 30 to 85 wt % of acrylonitrile and 15 to 65 wt % of another component from the viewpoint of flame retardancy. It is preferable to use, as the other component, one or more halogen-containing monomers selected from, for example, the group consisting of halogen-containing vinyl monomers and halogen-containing vinylidene monomers, from the viewpoint of flame retardancy. The content of acrylonitrile in the acrylonitrile copolymer may be 40 to 75 wt %. The content of a halogen-containing vinyl monomer and/or a halogen-containing vinylidene monomer in the acrylonitrile copolymer may be 25 to 60 wt %. The acrylonitrile copolymer may further contain a monomer having a sulfonic group as the other component. The content of the monomer having a sulfonic group in the acrylonitrile copolymer may be 0 to 3 wt %.

Examples of the halogen-containing monomers include halogen-containing vinyl monomers and halogen-containing vinylidene monomers. Examples of the halogen-containing vinyl monomers include vinyl chloride and vinyl bromide, and examples of the halogen-containing vinylidene monomers include vinylidene chloride and vinylidene bromide. These halogen-containing monomers may be used alone or in combination of two or more. A vinyl chloride monomer is preferable to a vinylidene chloride monomer. In the case of using the vinyl chloride monomer, by selecting a magnesium compound as a flame retardant and blending it in a specific blend amount, a char layer is likely to be formed during combustion, and thus high flame retardancy is exhibited. The mechanism behind this is not clear, but it is assumed that, when vinyl chloride is present, a magnesium compound functions as an intumescent flame retardant, and thus a char layer, namely an intumescent, is likely to be formed during combustion. If vinylidene chloride is used, when a magnesium compound is selected as a flame retardant, an acrylonitrile copolymer is colored, and its use for clothing is restricted. However, coloring of an acrylonitrile copolymer does not progress in the case of using vinyl chloride, which is preferable.

Although there is no particular limitation on the monomer having a sulfonic group, examples thereof include unsaturated carboxylic acids such as acrylic acid and methacrylic acid, salts of the unsaturated carboxylic acids, methacrylic acid esters such as methyl methacrylate, esters of unsaturated carboxylic acids such as glycidyl methacrylate, vinyl esters such as vinyl acetate and vinyl butyrate, and sulfonic acid-containing monomers. Although there is no particular limitation on the sulfonic acid-containing monomers, examples thereof include allylsulfonic acid, methallylsulfonic acid, styrenesulfonic acid, isoprenesulfonic acid, and 2-acrylamido-2-methylpropanesulfonic acid, and metallic salts (e.g., sodium salts) thereof and amine salts thereof. These other copolymerizable monomers having a sulfonic group may be used alone or in combination of two or more. The monomer having a sulfonic group is used as needed, but when the content of the monomer having a sulfonic group in the above-mentioned acrylonitrile copolymer is 0 to 3 wt %, the production stability in the spinning process will be very high.

In one or more embodiments of the present invention, from the viewpoint of improving the flame retardancy and the spinnability of the modacrylic fiber, the acrylonitrile copolymer may contain acrylonitrile in an amount of 30 to 85 wt %, the halogen-containing monomer in an amount of 15 to 65 wt %, and the monomer having a sulfonic group in an amount of 0 to 3 wt %. The acrylonitrile copolymer may contain acrylonitrile in an amount of 35 to 80 wt %, the halogen-containing monomer in an amount of 20 to 65 wt %, and the monomer having a sulfonic group in an amount of 0 to 3 wt %. The acrylonitrile copolymer may contain acrylonitrile in an amount of 40 to 75 wt %, the halogen-containing monomer in an amount of 25 to 60 wt %, and the monomer having a sulfonic group in an amount of 0 to 3 wt %. The acrylonitrile copolymer may contain acrylonitrile in an amount of 40 to 70 wt %, the halogen-containing monomer in an amount of 30 to 60 wt %, and the monomer having a sulfonic group in an amount of 0 to 3 wt %.

In one or more embodiments of the present invention, from the viewpoint of improving the lightness of the modacrylic fiber in addition to the flame retardancy and the spinnability thereof, the acrylonitrile copolymer may contain acrylonitrile in an amount of 30 to 85 wt %, vinyl chloride in an amount of 15 to 65 wt %, and the monomer having a sulfonic group in an amount of 0 to 3 wt %. The acrylonitrile copolymer may contain acrylonitrile in an amount of 35 to 80 wt %, vinyl chloride in an amount of 20 to 65 wt %, and the monomer having a sulfonic group in an amount of 0 to 3 wt %. The acrylonitrile copolymer may contain acrylonitrile in an amount of 40 to 75 wt %, vinyl chloride in an amount of 25 to 60 wt %, and the monomer having a sulfonic group in an amount of 0 to 3 wt %. The acrylonitrile copolymer may contain acrylonitrile in an amount of 40 to 70 wt %, vinyl chloride in an amount of 30 to 60 wt %, and the monomer having a sulfonic group in an amount of 0 to 3 wt %.

In one or more embodiments of the present invention, the modacrylic fiber contains the acrylonitrile copolymer and the magnesium compound, and is used to improve the flame retardancy of a flame-retardant fabric. The modacrylic fiber is charred during combustion and thus serves to deplete oxygen inside the flame-retardant fabric and to help prevention of the entrance of flame on the surface of the fabric. Also, the modacrylic fiber contains the magnesium compound inside the fiber, and therefore, a fabric containing the modacrylic fiber has favorable washing durability, that is, favorable flame retardancy after washing.

In one or more embodiments of the present invention, due to the modacrylic fiber containing the magnesium compound, it is possible to obtain a flame-retardant fabric that is capable of suppressing generation of carbon monoxide, which is a harmful gas, during combustion compared with a modacrylic fiber containing an antimony compound, has excellent flame retardancy while suppressing the environmental impact, and is less colored (has high lightness).

In one or more embodiments of the present invention, the single-fiber strength of the modacrylic fiber may be 1.0 to 4.0 cN/dtex or 1.5 to 3.5 cN/dtex, for example, from the viewpoint of durability. The elongation at break of the modacrylic fiber may be 15 to 40% or 20 to 30%, for example, from the viewpoint of practicality. The single-fiber strength and the elongation at break can be measured in accordance with JIS L 1015: 2010.

In one or more embodiments of the present invention, the modacrylic fiber is a fiber capable of being solution-dyed. The term "solution-dyeing" means that a raw material (a spinning solution, a solution containing a polymer, or a polymer) of a chemical fiber is colored by adding a coloring material such as a pigment or dye to the raw material, and the modacrylic fiber can be solution-dyed. Solution-dyeing makes it easy to achieve a desired color without performing an additional production step, and furthermore, a fiber that is less prone to color migration during washing and color loss can be obtained.

In one or more embodiments of the present invention, the modacrylic fiber may contain another flame retardant whose environmental impact is not of concern when eluted or discharged, other than a magnesium compound as needed. Also, the modacrylic fiber may contain other additives such as an antistatic agent (also called a "static control agent"), a thermal coloration inhibitor, a light resistance improver, a whiteness improver, a devitrification inhibitor, and a coloring agent, as needed. Note that there is no particular limitation on an application method, and application may be performed through spraying and may be performed after cutting.

In one or more embodiments of the present invention, there is no particular limitation on a method for producing the modacrylic fiber, but the modacrylic fiber can be produced by spinning a composition containing an acrylonitrile copolymer (an acrylonitrile copolymer containing acrylonitrile and vinyl chloride) and a magnesium compound, followed by heat treatment. Specific examples of the production method include known methods such as a wet spinning method, a dry spinning method, and a semi-dry semi-wet method. For example, in the case of the wet spinning method, the modacrylic fiber can be produced as follows. That is, a spinning solution is extruded into a coagulation bath through a nozzle and is thus coagulated, followed by drawing, washing using water, drying, heat treatment, and, if needed, crimping and cutting, as in the case of a common modacrylic fiber, except that the spinning solution is obtained by dissolving the acrylonitrile copolymer in an organic solvent and then adding a magnesium compound thereto. The modacrylic fiber is drawn during or before the washing using water, or before or after the drying. An oil may be applied to the fiber before the crimping or before the drying as needed. Examples of the organic solvent include dimethylformamide, dimethylacetamide, acetone, and dimethylsulfoxide, but an inorganic solvent such as an aqueous solution of a rhodan salt or an aqueous solution of nitric acid may also be used.

Cellulose Fiber

The flame-retardant fabric according to one or more embodiments of the present invention contains a cellulose fiber in an amount of 10 to 35 wt % with respect to the overall weight of the fabric for the purpose of imparting excellent texture and washing durability. The content of the cellulose fiber may be 15 to 30 wt % or 20 to 30 wt %. At least one selected from the group consisting of a natural cellulose fiber and a regenerated cellulose fiber can be used as the cellulose fiber. These fibers may be used alone or in combination of two or more.

Examples of the natural cellulose fiber include natural cellulose fibers such as a cotton fiber, a kapok fiber, a flax fiber, a hemp fiber, a ramie fiber, a jute fiber, a Manila hemp fiber, and a kenaf fiber.

Examples of the regenerated cellulose fiber include a rayon fiber, a flame-retardant rayon fiber, a lyocell fiber, and a flame-retardant lyocell fiber.

The rayon fiber is obtained by dissolving, in caustic soda, cellulose xanthate produced by the reaction of an alkali and carbon disulfide with a cellulose raw material, followed by wet spinning.

The lyocell fiber is obtained by dissolving a cellulose raw material in N-methylmorpholine N-oxide without performing a step of denaturing the cellulose raw material, followed by dry wet spinning.

The flame-retardant rayon fiber may be a rayon fiber containing a phosphorus-based flame retardant. There is no particular limitation on the phosphorus-based flame retardant, and examples thereof include phosphoric ester-based compounds, halogen-containing phosphoric ester-based compounds, condensed phosphoric ester-based compounds, polyphosphate-based compounds, and polyphosphoric ester-based compounds. Although there is no particular limitation on the flame-retardant rayon fiber containing the phosphorus-based flame retardant, the flame-retardant rayon fiber may contain phosphorus derived from the phosphorus-based flame retardant in an amount of 0.5 wt % or more, or 0.8 wt % or more, with respect to the overall weight of the fiber, for example, from the viewpoint of improving flame retardancy. Meanwhile, the flame-retardant rayon fiber containing the phosphorus-based flame retardant may contain phosphorus derived from the phosphorus-based flame retardant in an amount of 10 wt % or less with respect to the overall weight of the fiber, for example, from the viewpoint of fiber strength and the like. For example, commercially available flame-retardant rayon fibers such as flame-retardant lyocell "Lenzing FR" manufactured by Lenzing and flame-retardant rayon "JWELL FR" manufactured by Jilin Chemical Fibre Co., Ltd. may also be used as the flame-retardant rayon fiber containing the phosphorus-based flame retardant. The content of phosphorus can be measured using a fluorescent X-ray analysis method.

The flame-retardant lyocell fiber may be a lyocell fiber containing a phosphorus-based flame retardant. There is no particular limitation on the phosphorus-based flame retardant, and examples thereof include phosphoric ester-based compounds, halogen-containing phosphoric ester-based compounds, condensed phosphoric ester-based compounds, polyphosphate-based compounds, and polyphosphoric ester-based compounds.

Flame Retardant Fabric

In one or more embodiments of the present invention, the flame-retardant fabric contains the modacrylic fiber in an amount of 65 to 90 wt % with respect to the overall weight of the fabric. If the content of the modacrylic fiber is less than 65 wt %, the flame retardancy will be poor, and if the content of the modacrylic fiber exceeds 90 wt %, the content of the cellulose fiber will be excessively small, which leads to poor fabric texture.

In one or more embodiments of the present invention, the flame-retardant fabric may contain the modacrylic fiber in an amount of 70 to 90 wt % and the natural cellulose fiber in an amount of 10 to 30 wt % or may contain the modacrylic fiber in an amount of 80 to 90 wt % and the natural cellulose fiber in an amount of 10 to 20 wt %, from the viewpoint of compatibility between flame retardancy and texture.

In one or more other embodiments of the present invention, the flame-retardant fabric may contain the modacrylic fiber in an amount of 65 to 90 wt % and the rayon fiber in an amount of 10 to 35 wt %, or the flame-retardant fabric may contain the modacrylic fiber in an amount of 65 to 85 wt % and the rayon fiber in an amount of 15 to 35 wt %.

In one or more other embodiments of the present invention, the flame-retardant fabric may contain the modacrylic fiber in an amount of 65 to 90 wt % and the lyocell fiber in an amount of 10 to 35 wt %, or the flame-retardant fabric may contain the modacrylic fiber in an amount of 65 to 85 wt % and the lyocell fiber in an amount of 15 to 35 wt %.

In one or more other embodiments of the present invention, the flame-retardant fabric may contain the modacrylic fiber in an amount of 65 to 90 wt % and the flame-retardant rayon fiber in an amount of 10 to 35 wt %, or the flame-retardant fabric may contain the modacrylic fiber in an amount of 70 to 80 wt % and the flame-retardant rayon fiber in an amount of 20 to 30 wt %.

In one or more other embodiments of the present invention, the flame-retardant fabric may contain the modacrylic fiber in an amount of 65 to 90 wt % and the flame-retardant lyocell fiber in an amount of 10 to 35 wt %, or the flame-retardant fabric may contain the modacrylic fiber in an amount of 65 to 85 wt % and the flame-retardant lyocell fiber in an amount of 15 to 35 wt %.

In one or more embodiments of the present invention, the flame-retardant fabric may contain two or more of cellulose fibers selected from the group consisting of the rayon fiber, the flame-retardant rayon fiber, the lyocell fiber, and the flame-retardant lyocell fiber.

In the flame-retardant fabric according to one or more embodiments of the present invention, the natural cellulose fiber and the regenerated cellulose fiber may be used alone or in combination, and when they are used in combination, the weight ratio between the natural cellulose fiber and the regenerated cellulose fiber may be 1:2 to 3:1.

In one or more embodiments of the present invention, the flame-retardant fabric may contain another fiber in addition to the modacrylic fiber and the cellulose fiber as long as the effects of one or more embodiments of the present invention are not inhibited. Examples of the other fiber include a conductive fiber, a heat-resistant fiber, and a high-strength high-elasticity fiber. Examples of the conductive fiber include a metallic fiber, a metal-plated fiber, a copper compound-coated fiber, and a conductive material-containing fiber. Examples of the heat-resistant fiber include a meta-aramid fiber, a polyoxadiazole fiber, a polyimide fiber, and a polyamideimide fiber. Examples of the high-strength high-elasticity fiber include a nylon fiber, a polyester fiber, a para-aramid fiber, and a polyarylate fiber. The flame-retardant fabric may include the other fiber in an amount of 10 wt % or less, 8 wt % or less, or 1 wt % or less, with respect to the overall weight of the fabric.

In the flame-retardant fabric according to one or more embodiments of the present invention, the modacrylic fiber, the cellulose fiber, and the other fiber may be a short fiber or a long fiber from the viewpoint of strength, and it is possible to select which one is to be used, as appropriate, depending on how the flame-retardant fabric is to be used. Although the single fiber fineness is selected as appropriate depending on the application of work clothing produced using the fiber, the single fiber fineness may be 1 to 50 dtex, 1.5 to 30 dtex, or 1.7 to 15 dtex. The cut length is selected as appropriate depending on the application of the work clothing. For example, a short-cut fiber (with a fiber length of 0.1 to 5 mm, for example), a staple fiber (with a fiber length of 38 to 128 mm, for example), or a long fiber (filament) that is not cut at all can be used.

Although there is no particular limitation on the basis weight of the flame-retardant fabric according to one or more embodiments of the present invention, the basis weight may be 200 to 400 g/m$^2$, 220 to 380 g/m$^2$, or 250 to 350 g/m$^2$ from the viewpoint of texture.

There is no particular limitation on the form of the flame-retardant fabric, and examples thereof include a woven fabric and a knitted fabric. There is no particular limitation on the weave of the woven fabric. Three foundation weaves such as a plain weave, a twill weave, and a sateen weave may be applied, and a patterned woven fabric obtained by using a special loom such as a dobby loom or a Jacquard loom may be used. Also, there is no particular limitation on the knitting of the knitted fabric, and any of circular knitting, flat knitting, and warp knitting may be applied. The flame-retardant fabric may be a woven fabric, or a twill woven fabric, from the viewpoint of excellent durability.

In one or more embodiments of the present invention, the flame-retardant fabric has excellent flame retardancy, and its afterflame time and afterglow time measured using a flammability test based on ISO 15025: 2000 are 2 seconds or less and 2 seconds or less, respectively. The afterflame time may be 0 seconds and the afterglow time is 0 seconds. In one or more embodiments of the present invention, the limiting oxygen index of the flame-retardant fabric measured based on the method E (E-1) of JIS L 1091: 1999 may be 27 or more, 28 or more, 29 or more, 30 or more, 31 or more, 32 or more, 33 or more, 34 or more, 35 or more, or 36 or more, from the viewpoint of excellent flame retardancy. In one or more embodiments of the present invention, the washing durability may be examined by, for example, measuring, based on JIS L 1091: 1999, the limiting oxygen index of the flame-retardant fabric washed using a washing method based on ISO 6330: 2012, and when the flame-retardant fabric is washed 30 times using a washing method based on ISO 6330: 2012, the limiting oxygen index of the flame-retardant fabric measured based on the method E (E-1) of JIS L 1091: 1999 may be 27 or more, 28 or more, 29 or more, 30 or more, 31 or more, 32 or more, 33 or more, 34 or more, 35 or more, or 36 or more.

Work Clothing

In one or more embodiments of the present invention, the flame-retardant fabric can be favorably used as a fabric for work clothing required to have flame retardancy. In one or more embodiments of the present invention, the work clothing can be produced using the flame-retardant fabric through a known sewing method. In one or more embodiments of the present invention, the flame-retardant fabric has excellent flame retardancy and washing durability, and thus the work clothing also has excellent flame retardancy and washing durability. Also, since the flame-retardant fabric has excellent texture even after being repeatedly washed, the work clothing maintains its flame retardancy and texture even after being repeatedly washed. In one or more embodiments of the present invention, the work clothing can be used in any field of work in which flame retardancy is required. For example, the work clothing can be used as protective clothing (fire-fighting clothing) to be worn by a firefighter, protective clothing to be worn in workplaces in the fields of petroleum, petrochemistry, coal mining, electric power, welding, and the like in which accidents such as a fire may happen, and work clothing to be worn in workplaces in the fields of metalwork and the like in which accidents such as a dust explosion are likely to happen, but there is no particular limitation thereto.

EXAMPLES

Hereinafter, the present invention will be described in detail by way of examples. However, the present invention is not limited to the examples.

The following fibers were used in examples and comparative examples.

Fibers

- Modacrylic fiber I: a modacrylic fiber containing 100 parts by weight of an acrylonitrile copolymer (containing acrylonitrile in an amount of 49.5 wt %, vinyl chloride in an amount of 49.5 wt %, and sodium styrenesulfonate in an amount of 1.0 wt %) and 5 parts by weight of magnesium hydroxide (manufactured by Kyowa Chemical Industry Co., Ltd., product name "KISMA 5P", having an average particle diameter of 2 μm and Mohs hardness of 3), i.e., containing magnesium hydroxide in an amount of 4.8 wt % with respect to the overall weight of the fiber; single fiber fineness: 1.7 dtex; fiber length: 51 mm,
- Modacrylic fiber II: a modacrylic fiber containing 100 parts by weight of an acrylonitrile copolymer (containing acrylonitrile in an amount of 49.5 wt %, vinylidene chloride in an amount of 49.5 wt %, and sodium styrenesulfonate in an amount of 1.0 wt %) and 9.5 parts by weight of antimony pentoxide, i.e., containing antimony pentoxide in an amount of 8.7 wt % with respect to the overall weight of the fiber; single fiber fineness: 1.7 dtex; fiber length: 51 mm
- Modacrylic fiber III: a modacrylic fiber containing 100 parts by weight of an acrylonitrile copolymer (containing acrylonitrile in an amount of 49.5 wt %, vinyl chloride in an amount of 49.5 wt %, and sodium styrenesulfonate in an amount of 1.0 wt %) and 7 parts by weight of magnesium hydroxide (manufactured by Kyowa Chemical Industry Co., Ltd., product name "KISMA 5P", having an average particle diameter of 2 μm and Mohs hardness of 3), i.e., containing magnesium hydroxide in an amount of 6.5 wt % with respect to the overall weight of the fiber; single fiber fineness: 1.7 dtex; fiber length: 51 mm,
- Modacrylic fiber IV: a modacrylic fiber containing 100 parts by weight of an acrylonitrile copolymer (containing acrylonitrile in an amount of 49.5 wt %, vinyl chloride in an amount of 49.5 wt %, and sodium styrenesulfonate in an amount of 1.0 wt %) and 7.1 parts by weight of magnesium hydroxide (manufactured by Kyowa Chemical Industry Co., Ltd., product name "KISMA 5P", having an average particle diameter of 2 μm and Mohs hardness of 3), i.e., containing magnesium hydroxide in an amount of 6.6 wt % with respect to the overall weight of the fiber; single fiber fineness: 1.7 dtex; fiber length: 51 mm, Modacrylic fiber V: a modacrylic fiber containing 100 parts by weight of an acrylonitrile copolymer (containing acrylonitrile in an amount of 49.5 wt %, vinyl chloride in an amount of 49.5 wt %, and sodium styrenesulfonate in an amount of 1.0 wt %) and 7.3 parts by weight of magnesium hydroxide (manufactured by Kyowa Chemical Industry Co., Ltd., product name "KISMA 5P", having an average particle diameter of 2 μm and Mohs hardness of 3), i.e., containing magnesium hydroxide in an amount of 6.8 wt % with respect to the overall weight of the fiber; single fiber fineness: 1.7 dtex; fiber length: 51 mm, Modacrylic fiber VI: a modacrylic fiber containing 100 parts by weight of an acrylonitrile copolymer (containing acrylonitrile in an amount of 49.5 wt %, vinyl chloride in an amount of 49.5 wt %, and sodium styrenesulfonate in an amount of 1.0 wt %) and 7.5 parts by weight of magnesium hydroxide (manufactured by Kyowa Chemical Industry Co., Ltd., product name "KISMA 5P", having an average particle diameter of 2 μm and Mohs hardness of 3), i.e., containing magnesium hydroxide in an amount of 7.0 wt % with respect to the overall weight of the fiber; single fiber fineness: 1.7 dtex; fiber length: 51 mm, Flame-retardant lyocell fiber: "Lenzing FR (registered trademark)" manufactured by Lenzing, containing a phosphorus-based flame retardant; single fiber fineness: 2.2 dtex; fiber length: 51 mm Lyocell fiber: "Tencel (registered trademark)" manufactured by Lenzing; single fiber fineness: 1.3 dtex; fiber length: 51 mm Natural cellulose fiber: a cotton fiber with a cut length of 31 mm or less Meta-aramid fiber: "Newstar (registered trademark)" manufactured by Yantai Tayho Advanced Materials Co., Ltd; fiber fineness: 1.7 dtex; fiber length: 51 mm Examples 1 to 11, Comparative Examples 1, 2, 4 and 5, Reference Example 1

Spun yarns of count Nos. shown in Table 1 below were produced through ordinary ring spinning using the fibers in the blend amounts shown in Table 1 below, and these spun yarns were used to produce plain-knitted fabrics having a basis weight shown in Table 1 below.

Comparative Example 3

Spun yarn of count No. shown in Table 1 below was produced through ordinary ring spinning using the natural cellulose fiber in an amount of 100 wt %, and this spun yarn was used to produce a plain-knitted fabric having a basis weight shown in Table 1 below. The obtained knitted fabrics was subjected to the following processing.

Pyrovatex treatment was performed using a phosphorus-based compound to impart flame retardancy. First, a flame-retardancy imparting liquid (processing agent) containing a phosphorus-based compound (trade name "Pyrovatex CP NEW", manufactured by Huntsman, N-methylol dimethylphosphonopropionamide) at a concentration of 400 g/L, a cross-linking agent (trade name "BECKAMINE J-101", manufactured by DIC, hexamethoxymethylol-melamine) at a concentration of 60 g/L, a softener (trade name "ULTRATEX FSA NEW", manufactured by Huntsman; silicone-based softener) at a concentration of 30 g/L, 85% phosphoric acid at a concentration of 20.7 g/L, and a penetrating agent (trade name "INVADINE PBN", manufactured by Huntsman) at a concentration of 5 ml/L was prepared. After the flame-retardancy imparting liquid had sufficiently permeated into the knitted fabric, the flame-retardancy imparting liquid was squeezed out of the knitted fabric using a hydroextractor such that the squeeze ratio was 80±2%, and then the knitted fabric was predried at 110° C. for 5 minutes and subjected to heat treatment at 150° C. for 5 minutes. Thereafter, the knitted fabric was washed with an aqueous solution of sodium carbonate and water, and neutralized with an aqueous solution of hydrogen peroxide. The knitted fabric was washed with water and dewatered, and then dried at 60° C. for 30 minutes using a tumbler dryer. Thus, a flame-retardant knitted fabric was obtained.

The flame retardancy, texture, and washing durability of each of the knitted fabrics obtained in the examples and comparative examples were evaluated as follows. Table 2 below shows the results.

Flame Retardancy Evaluation 1

A flammability test was performed based on the method A of ISO 15025: 2000 to measure the afterflame time and the afterglow time. The flame retardancy acceptability criterion are "flame does not reach at least one of the upper end, the left end, and the right end of a test piece", "the afterflame time and the afterglow time are 2 seconds or less", and "no hole is formed in the cloth", and when the acceptability criterion were satisfied, the flame retardancy was determined as "Good".

Flame Retardancy Evaluation 2

The method based on the method E (E-1) of JIS L 1091: 1999 was used to measure the limiting oxygen index (LOI) of the knitted fabric. When the LOI value was 27 or more, the flame retardancy was determined as "Good".

Washing Durability

The knitted fabric was washed 30 times based on ISO 6330: 2012, and then the limiting oxygen index (LOI) of the washed knitted fabric was measured using the method based on the method E (E-1) of JIS L 1091: 1999. When the LOI value of the knitted fabric after washed 30 times was 27 or more, the washing durability was determined as "Good".

Texture

Sensory evaluation experts performed sensory evaluation of the softness of the knitted fabric, and evaluated the texture using the following criteria.

Good: The knitted fabric was soft.

Poor: The knitted fabric was hard.

(Amount of Static Electricity During Spinning)

In the production process of spun yarns, the amount of static electricity generated as fibers passed through a carding machine was measured with an electrostatic meter ("FMX-003" manufactured by SIMCO JAPAN). The measured value was defined as an amount of static electricity during spinning. The smaller the absolute value of the amount of static electricity during spinning, the better the spinning stability.

TABLE 1

| | Blend ratio (wt*) | | | | | | | | | | Content of magnesium compound in | Spun yarn | Knitted fabric | |
|---|---|---|---|---|---|---|---|---|---|---|---|---|---|---|
| | Modacrylic fiber | | | | | | Natural cellulose | Lyocell | Frame retardant | Meta aramid | Modacrylic fiber | Count No. | Basis weight | Content of compound |
| | I | II | III | IV | V | VI | fiber | fiber | lyocell fiber | fiber | (wt %) | (NE) | ($g/m^2$) | (wt %) |
| Ex. 1 | 90 | | | | | | 10 | | | | 4.8 | 16/1 | 945 | 4.3 |
| Ex. 2 | 80 | | | | | | 20 | | | | 4.8 | 16/1 | 280 | 3.8 |
| Ex. 3 | 70 | | | | | | 20 | | | 10 | 4.8 | 16/1 | 251 | 3.3 |
| Ex. 4 | 90 | | | | | | | 10 | | | 4.8 | 15/1 | 284 | 4.3 |
| Ex. 5 | 65 | | | | | | | 35 | | | 4.8 | 15/1 | 955 | 3.1 |
| Ex. 6 | 90 | | | | | | | | 10 | | 4.8 | 15/1 | 202 | 4.3 |
| Ex. 7 | 65 | | | | | | | | 35 | | 4.8 | 15/1 | 250 | 3.1 |
| Ex. 8 | 85 | | | | | | 16 | | | | 4.8 | 19/1 | 190 | 4.0 |
| Ex. 9 | | | | 65 | | | 35 | | | | 6.6 | 20/1 | 190 | 4.3 |
| Ex. 10 | | | | | 65 | | 35 | | | | 6.8 | 20/1 | 190 | 4.4 |
| Ex. 11 | | | | | | 65 | 35 | | | | 7.0 | 20/1 | 180 | 4.5 |
| Comp. Ex. 1 | 100 | | | | | | | | | | 0.0 | 13/1 | 261 | 4.8 |
| Comp. Ex. 2 | 50 | | | | | | | 50 | | | 0.0 | 15/1 | 253 | 2.4 |
| Comp. Ex. 3 | | | | | | | 100 | | | | 0.0 | 20/1 | 260 | 0.0 |
| Comp. Ex. 4 | 55 | | | | | | 45 | | | | 4.8 | 21/1 | 179 | 2.6 |
| Comp. Ex. 6 | | | 65 | | | | 45 | | | | 6.6 | 20/1 | 210 | 8.6 |
| Ref. Ex. 1 | | 55 | | | | | 45 | | | | 0.0 | 18/1 | 264 | 0.0 |

TABLE 2

| | Flame retardancy | | | | | | Washing durability LOI value | Amount of static electricity |
|---|---|---|---|---|---|---|---|---|
| | Evaluation 1 | | | | Evaluation 2 | | after | (V) |
| | Afterflame time (s) | Afterglow time (s) | Hole is present | Evaluation | LOI value | Texture | washed 30 times | during spinning |
| Ex. 1 | 0 | 0 | No | Good | 36 | Good | 36 | — |
| Ex. 2 | 0 | 0 | No | Good | 33 | Good | 33 | — |
| Ex. 3 | 0 | 0 | No | Good | 33 | Good | — | — |
| Ex. 4 | 0 | 0 | No | Good | 36 | Good | 36 | — |
| Ex. 5 | 0 | 0 | No | Good | 29 | Good | — | — |
| Ex. 6 | 0 | 0 | No | Good | 36 | Good | — | — |
| Ex. 7 | 0 | 0 | No | Good | 29 | Good | — | — |
| Ex. 8 | 0 | 0 | No | Good | 36 | Good | 35 | 0 |
| Ex. 9 | 0 | 0 | No | Good | 29 | Good | 29 | 100 |
| Ex. 10 | 0 | 0 | No | Good | 29 | Good | 29 | 300 |
| Ex. 11 | 0 | 0 | No | Good | 29 | Good | 29 | 300 |
| Comp. Ex. 1 | 0 | 0 | Yes | Poor | 40 | Good | — | — |
| Comp. Ex. 2 | 54 | 0 | No | Poor | 24 | Good | — | — |
| Comp. Ex. 3 | 0 | 0 | No | Good | 33 | Poor | 25 | — |
| Comp. Ex. 4 | Burned | Burned | | Bad | 28 | Good | 28 | — |
| Comp. Ex. 5 | Burned | Burned | | Bad | 28 | Good | 28 | 100 |
| Ref. Ex 1 | 0 | 0 | No | Good | 33 | Good | 33 | — |

It is clear from the results shown in Table 2 above that the knitted fabrics of the examples had excellent flame retardancy and a favorable texture. The knitted fabrics of the examples produced using a modacrylic fiber containing a magnesium compound as a flame retardant had favorable flame retardancy as in the case of the knitted fabric of Reference Example 1 produced using a modacrylic fiber containing an antimony compound as a flame retardant. In each of the knitted fabrics of the examples, the magnesium compound was contained inside the modacrylic fiber, and therefore, the LOI value of the knitted fabric after being washed 30 times was the same as that before washing, and the washing durability, namely the flame retardancy after washing, was also good.

As can be seen from the comparison between Examples 8, 9 and Examples 10, 11, when the content of the magnesium compound in the modacrylic fiber was 6.7 wt % or less, the generation of static electricity during spinning was reduced, resulting in high spinning stability. On the other hand, when the content of the magnesium compound in the modacrylic fiber was more than 6.7 wt %, the absolute value of the amount of static electricity during spinning was increased, resulting in low spinning stability.

Meanwhile, when the flammability test based on the method A of ISO 15025: 2000 was performed, a hole was formed in the knitted fabric of Comparative Example 1 containing no cellulose fibers, and the flame retardancy (more specifically, flame blocking ability) was poor.

In the flammability test based on the method A of ISO 15025: 2000, the afterflame time of the knitted fabric of Comparative Example 2 containing the modacrylic fiber and the magnesium compound in small amounts was 54 seconds, and the flame retardancy (more specifically, flame blocking ability) was poor. Also, the limiting oxygen index (LOI) measured using the method based on the method E (E-1) of JIS L 1091: 1999 was only 24, and the flame retardancy was poor.

The knitted fabric of Comparative Example 3 containing no modacrylic fibers and no magnesium compounds had favorable flame retardancy since it contained the phosphorus-based compound serving as a flame retardant. However, the texture was poor due to the phosphorus-based compound attaching to the fabric (fiber). Also, since the phosphorus-based compound was attached to the fiber and was not contained inside the fibers, the LOI value of the knitted fabric after washed 30 times was significantly smaller than that before washing, and the washing durability, namely the flame retardancy after washing, was poor.

In the flammability test based on the method A of ISO 15025: 2000, the knitted fabrics of Comparative Examples 4 and 5, each of which contained a small amount of the modacrylic fiber, were completely burned and thus had very poor flame retardancy.

One or more embodiments of the present invention are not particularly limited, but may encompass the following embodiments.

[1] A flame-retardant fabric including: a modacrylic fiber; and a cellulose fiber, wherein the cellulose fiber is one or more selected from the group consisting of a regenerated cellulose fiber and a natural cellulose fiber, the flame-retardant fabric contains the modacrylic fiber in an amount of 65 to 90 wt % and the cellulose fiber in an amount of 10 to 35 wt % with respect to the overall weight of the fabric, the modacrylic fiber contains magnesium hydroxide inside the fiber, the flame-retardant fabric contains magnesium hydroxide in an amount of 2.5 to 4.5 wt % with respect to the overall weight of the fabric, and afterflame time and afterglow time of the flame-retardant fabric measured using a flammability test based on ISO 15025: 2000 are 2 seconds or less and 2 seconds or less, respectively.

[2] The flame-retardant fabric according to [1], wherein the modacrylic fiber contains an acrylonitrile copolymer that includes acrylonitrile in an amount of 30 to 85 wt %, one or more halogen-containing monomers selected from the group consisting of a halogen-containing vinyl monomer and a halogen-containing vinylidene monomer in an amount of 15 to 65 wt %, and a vinyl monomer having a sulfonic group in an amount of 0 to 3 wt %.

[3] The flame-retardant fabric according to [1] or [2], wherein the modacrylic fiber contains magnesium hydroxide inside the fiber in an amount of 2.8 to 6.7 wt %.

[4] The flame-retardant fabric according to any one of [1] to [3], wherein the regenerated cellulose fiber is one or more selected from the group consisting of a rayon fiber, a flame-retardant rayon fiber, a lyocell fiber, and a flame-retardant lyocell fiber.

[5] The flame-retardant fabric according to any one of [1] to [4], wherein the flame-retardant fabric contains the modacrylic fiber in an amount of 65 to 90 wt % and the regenerated cellulose fiber in an amount of 10 to 35 wt % with respect to the overall weight of the fabric.

[6] The flame-retardant fabric according to any one of [1] to [4], wherein the flame-retardant fabric contains the modacrylic fiber in an amount of 65 to 90 wt %, the regenerated cellulose fiber in an amount of 10 to 35 wt %, and another fiber in an amount of 0 to 10 wt % with respect to the overall weight of the fabric.

[7] The flame-retardant fabric according to [5] or [6], wherein the regenerated cellulose fiber is one or more selected from the group consisting of a lyocell fiber and a flame-retardant lyocell fiber.

[8] The flame-retardant fabric according to any one of [1] to [4], wherein the flame-retardant fabric comprises the modacrylic fiber in an amount of 70 to 90 wt %, and the natural cellulose fiber in an amount of 10 to 30 wt %, with respect to the overall weight of the fabric.

[9] The flame-retardant fabric according to any one of [1] to [4], wherein the flame-retardant fabric contains the modacrylic fiber in an amount of 80 to 90 wt % and the natural cellulose fiber in an amount of 10 to 20 wt % with respect to the overall weight of the fabric.

[10] The flame-retardant fabric according to any one of [1] to [4], wherein the flame-retardant fabric contains the modacrylic fiber in an amount of 70 to 90 wt %, the natural cellulose fiber in an amount of 10 to 20 wt %, and another fiber in an amount of 0 to 10 wt % with respect to the overall weight of the fabric.

[11] The flame-retardant fabric according to [6] or [9], wherein the other fiber is one or more selected from the group consisting of a metallic fiber, a metal-plated fiber, a copper compound-coated fiber, a conductive material-containing fiber, a meta-aramid fiber, a polyoxadiazole fiber, a polyimide fiber, a polyamideimide fiber, a nylon fiber, a polyester fiber, a para-aramid fiber, and a polyarylate fiber, and may be a meta-aramid fiber.

[12] The flame-retardant fabric according to any one of [1] to [4], wherein the flame-retardant fabric contains the modacrylic fiber, the regenerated cellulose fiber, and the natural cellulose fiber, and a weight ratio between the regenerated cellulose fiber and the natural cellulose fiber is 1:2 to 3:1.

[13] The flame-retardant fabric according to any one of [1] to [12], wherein the modacrylic fiber is a solution-dyed fiber.

[14] The flame-retardant fabric according to any one of [1] to [13], which is a knitted fabric.

[15] A work clothing comprising the flame-retardant fabric according to any one of [1] to [14].

Although the disclosure has been described with respect to only a limited number of embodiments, those skilled in the art, having benefit of this disclosure, will appreciate that various other embodiments may be devised without departing from the scope of the present disclosure. Accordingly, the scope of the invention should be limited only by the attached claims.

The invention claimed is:

1. A flame-retardant fabric comprising:

a modacrylic fiber; and a cellulose fiber, wherein:

the cellulose fiber is one or more selected from the group consisting of a regenerated cellulose fiber and a natural cellulose fiber, the flame-retardant fabric comprises the modacrylic fiber in an amount of 80 to 90 wt % and the cellulose fiber in an amount of 10 to 15 wt % with respect to the overall weight of the fabric, the modacrylic fiber comprises magnesium hydroxide inside the fiber, the flame-retardant fabric comprises magnesium hydroxide in an amount of 2.5 to 4.5 wt % with respect to the overall weight of the fabric, and afterflame time and afterglow time of the flame-retardant fabric measured using a flammability test based on ISO 15025:2000 are 2 seconds or less and 2 seconds or less, respectively.

2. The flame-retardant fabric according to claim 1, wherein the modacrylic fiber comprises an acrylonitrile copolymer that comprises acrylonitrile in an amount of 30 to 85 wt %, one or more halogen-containing monomers selected from the group consisting of a halogen-containing vinyl monomer and a halogen-containing vinylidene monomer in an amount of 15 to 65 wt %, and a vinyl monomer having a sulfonic group in an amount of 0 to 3 wt %.

3. The flame-retardant fabric according to claim 1, wherein the modacrylic fiber comprises magnesium hydroxide inside the fiber in an amount of 2.8 to 6.7 wt %.

4. The flame-retardant fabric according to claim 1, wherein the regenerated cellulose fiber is one or more selected from the group consisting of a rayon fiber, a flame-retardant rayon fiber, a lyocell fiber, and a flame-retardant lyocell fiber.

5. The flame-retardant fabric according to claim 1, wherein the flame-retardant fabric comprises the modacrylic fiber in an amount of 80 to 90 wt % and the regenerated cellulose fiber in an amount of 10 to 15 wt % with respect to the overall weight of the fabric.

6. The flame-retardant fabric according to claim 1, wherein the flame-retardant fabric comprises the modacrylic fiber in an amount of 80 to 90 wt %, the regenerated cellulose fiber in an amount of 10 to 15 wt %, and another fiber in an amount of 0 to 10 wt % with respect to the overall weight of the fabric.

7. The flame-retardant fabric according to claim 5, wherein the regenerated cellulose fiber is one or more selected from the group consisting of a lyocell fiber and a flame-retardant lyocell fiber.

8. The flame-retardant fabric according to claim 1, wherein the flame-retardant fabric comprises the modacrylic fiber in an amount of 80 to 90 wt %, and the natural cellulose fiber in an amount of 10 to 15 wt %, with respect to the overall weight of the fabric.

9. The flame-retardant fabric according to claim 1, wherein the flame-retardant fabric comprises the modacrylic fiber in an amount of 80 to 90 wt %, the natural cellulose fiber in an amount of 10 to 15 wt %, and another fiber in an amount of 0 to 10 wt % with respect to the overall weight of the fabric.

10. The flame-retardant fabric according to claim 6, wherein the other fiber is one or more selected from the group consisting of a metallic fiber, a metal-plated fiber, a copper compound-coated fiber, a conductive material-containing fiber, a meta-aramid fiber, a polyoxadiazole fiber, a polyimide fiber, a polyamideimide fiber, a nylon fiber, a polyester fiber, a para-aramid fiber, and a polyarylate fiber.

11. The flame-retardant fabric according to claim 1, wherein the flame-retardant fabric comprises the modacrylic fiber, the regenerated cellulose fiber, and the natural cellulose fiber, and a weight ratio between the regenerated cellulose fiber and the natural cellulose fiber is 1:2 to 3:1.

12. The flame-retardant fabric according to claim 1, wherein the modacrylic fiber is a solution-dyed fiber.

13. The flame-retardant fabric according to claim 1, which is a knitted fabric.

14. A work clothing comprising the flame-retardant fabric according to claim 1.

15. The work clothing according to claim 14, wherein the modacrylic fiber comprises magnesium hydroxide inside the fiber in an amount of 2.8 to 6.7 wt %.

16. The work clothing according to claim 14, wherein the flame-retardant fabric comprises the modacrylic fiber in an amount of 80 to 90 wt %, and the natural cellulose fiber in an amount of 10 to 15 wt %, with respect to the overall weight of the fabric.

17. The work clothing according to claim 14, wherein the flame-retardant fabric comprises the modacrylic fiber in an amount of 80 to 90 wt %, the natural cellulose fiber in an amount of 10 to 15 wt %, and another fiber in an amount of 0 to 10 wt % with respect to the overall weight of the fabric.

* * * * *